US012752987B2

(12) United States Patent
Barbarino et al.

(10) Patent No.: US 12,752,987 B2
(45) Date of Patent: Oct. 6, 2026

(54) STRAW-IN-STRAW DEGASSING UNITS AND CONTAINERS THEREOF

(71) Applicant: L'OREAL, Paris (FR)

(72) Inventors: Casey Barbarino, San Anselmo, CA (US); John Boland, San Francisco, CA (US)

(73) Assignee: L'OREAL, Paris (FR)

( * ) Notice: Subject to any disclaimer, the term of this patent is extended or adjusted under 35 U.S.C. 154(b) by 142 days.

(21) Appl. No.: 18/928,602

(22) Filed: Oct. 28, 2024

(65) Prior Publication Data

US 2026/0116631 A1 Apr. 30, 2026

(51) Int. Cl.
*B65D 51/16* (2006.01)

(52) U.S. Cl.
CPC ..... *B65D 51/1644* (2013.01)

(58) Field of Classification Search
CPC ..... B65D 51/1644; B05B 11/0059
See application file for complete search history.

(56) References Cited

U.S. PATENT DOCUMENTS 2,850,211 A * 9/1958 Fernandez ..... A61M 5/14 604/249
3,113,698 A * 12/1963 Abplanalp ..... B65D 83/68 222/402.1
3,176,718 A 4/1965 Ruegger
3,631,880 A * 1/1972 Hansel ..... F04B 53/1037 222/464.6
3,890,952 A 6/1975 Hamre
4,401,095 A 8/1983 DuLoft
4,722,463 A * 2/1988 Anderson ..... B67D 3/046 222/509
5,195,664 A * 3/1993 Rhea ..... B05B 11/0059 222/464.6

(Continued)

FOREIGN PATENT DOCUMENTS

CN 1205617 A 1/1999
EP 2990126 A1 * 3/2016 ..... B05B 11/0039
FR 2641480 A1 * 7/1990 ..... B05B 11/0059

OTHER PUBLICATIONS

International Search Report and Written Opinion mailed Mar. 3, 2026, issued in corresponding International Application No. PCT/US2025/049886, filed Oct. 7, 2025, 13 pages.

*Primary Examiner* — Bob Zadeh
(74) *Attorney, Agent, or Firm* — CHRISTENSEN O'CONNOR JOHNSON KINDNESS PLLC

(57) ABSTRACT

A straw-in-straw degassing unit for degassing liquid formulas and compositions, and pouches and dispensing containers including the degassing unit. A straw-in-straw degassing unit is comprised of an outer tube and includes a first outer tube aperture at a first outer tube location and a second outer tube aperture at a second outer tube location. An inner tube is slidably nested within an interior of the outer tube, and includes a first inner tube aperture and a buoyant element coupled to the inner tube. The inner and outer tubes slidably interact, with changes in a gravitational orientation of the degassing unit, for conditional alignment of apertures therebetween and degassing of liquid formulas and compositions; in this manner, a liquid can be expulsed from a container without substantial expulsion of gas therefrom.

15 Claims, 9 Drawing Sheets

(56) References Cited

U.S. PATENT DOCUMENTS

| | | | | |
|---|---|---|---|---|
| 5,850,947 | A * | 12/1998 | Kim | B05B 15/30 222/464.5 |
| 2007/0205224 | A1* | 9/2007 | Glynn | G01F 11/288 222/207 |
| 2018/0060258 | A1 | 3/2018 | Wang et al. | |
| 2019/0067336 | A1 | 2/2019 | Yamazaki et al. | |
| 2020/0009333 | A1* | 1/2020 | Dunne | B05B 15/33 |
| 2021/0196021 | A1 | 7/2021 | Levi et al. | |
| 2022/0142452 | A1 | 5/2022 | Dietrich et al. | |
| 2024/0172858 | A1 | 5/2024 | Jablonski et al. | |
| 2026/0116631 | A1* | 4/2026 | Barbarino | B65D 51/1644 |

* cited by examiner

STRAW-IN-STRAW DEGASSING UNITS AND CONTAINERS THEREOF

SUMMARY

Aspects of the present disclosure relate to formulation pouches with a straw-in-straw degassing unit.

In an aspect, the disclosure provides a straw-in-straw degassing unit with an output nozzle; an outer tube, the outer tube comprising a first side and a second side, wherein the first side of the outer tube is coupled to the output nozzle, thereby placing an interior of the outer tube in fluid communication with an outlet of the output nozzle, the outer tube further comprising: a first outer tube aperture defined along a wall of the outer tube in a first outer tube location proximate the first side of the outer tube, and a second outer tube aperture defined along the wall of the outer tube in a second outer tube location proximate the second side of the outer tube; an inner tube nested within an interior of the outer tube and wherein an exterior of the inner tube is configured to slidably contact the interior of the outer tube, the inner tube comprising a first side and a second side, the inner tube further comprising a first inner tube aperture defined along a wall of the inner tube; and a buoyant element coupled to the second side of the inner tube and disposed exterior to the second side of the outer tube, wherein a diameter of the buoyant element is greater than an internal diameter of the outer tube.

In an aspect, the disclosure provides a formulation pouch, comprising: a formulation packet defining a formulation chamber; and a straw-in-straw degassing unit, wherein the straw-in-straw degassing unit is disposed within the formulation chamber, and wherein the output nozzle is disposed at a first side of the formulation packet.

In embodiments, the formulation pouch includes a non-gaseous formulation disposed inside the formulation chamber. The non-gaseous formulation comprises a formulation density and the buoyant element comprises a buoyant element density. In embodiments, a magnitude of the buoyant element density is smaller than a magnitude of the formulation density. In embodiments, the buoyant element comprises an encapsulated air pocket.

In embodiments, when the first inner tube aperture aligns with the second outer tube aperture, a first inlet channel is defined, thereby permitting a flow of non-gaseous formulation from the formulation chamber, through the second outer tube aperture, the first inner tube aperture, and an interior of the inner tube, and out through the output nozzle. In embodiments, when the first inner tube aperture is not aligned with the second outer tube aperture, a second inlet channel is formed through the first outer tube aperture, thereby permitting a flow of non-gaseous formulation from the formulation chamber, through the first outer tube aperture and an interior of the outer tube, and out through the output nozzle.

In embodiments, the first inner tube aperture comprises a plurality of first inner tube micro-bores formed around a circumference of the inner tube. In embodiments, the first outer tube aperture comprises a plurality of first outer tube micro-bores formed substantially around a circumference of the outer tube at the first outer tube location. In embodiments, the second outer tube aperture comprises a plurality of second outer tube micro-bores formed substantially around a circumference of the outer tube at the second outer tube location. In embodiments, the second side of the inner tube defines an aperture that is in fluid communication with the formulation chamber. In embodiments, the outer tube further comprises a third outer tube aperture, a fourth outer tube aperture, a fifth outer tube aperture, a sixth outer tube aperture, a seventh outer tube aperture, an eighth outer tube aperture, a ninth outer tube aperture, or a tenth outer tube aperture. In embodiments, the inner tube further comprises a second inner tube aperture, a third inner tube aperture, a fourth inner tube aperture, or a fifth inner tube aperture.

In embodiments, the formulation pouch further comprises a porous cage configured to encapsulate the outer tube and buoyant module without contacting the outer tube or buoyant module. The porous cage can contact a second side of the formulation packet.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

TABLE 1

Figure 1:
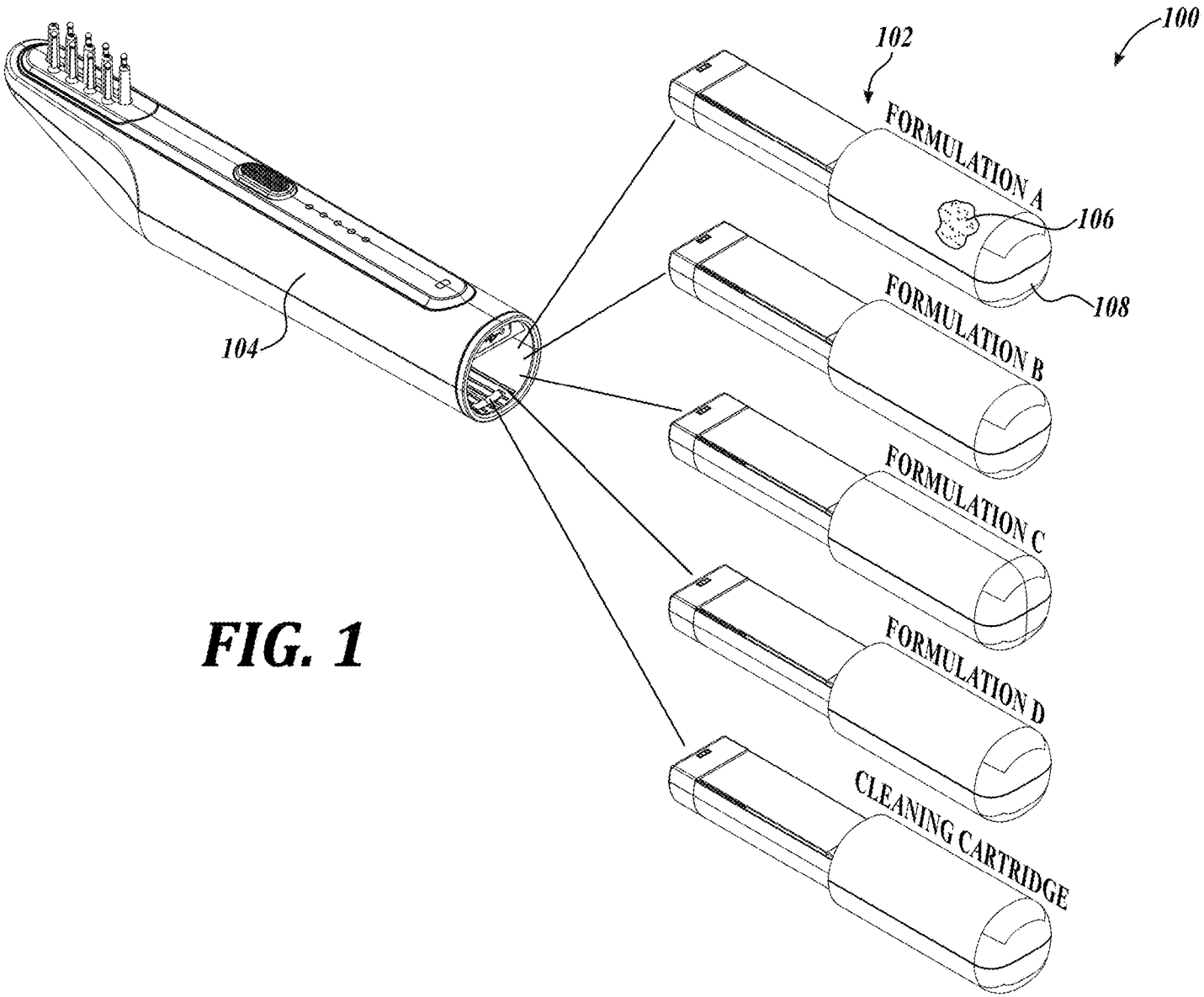
FIG. 1 is a schematic view of a formulation delivery system, according to aspects of the present disclosure.

| Listing of Drawing Elements |
|---|
| 100 formulation delivery system |
| 102 formulation product line |
| 104 formulation delivery device |
| 106 formulation |
| 108 formulation cartridge |
| 200 formulation cartridge |
| 202 handle portion |
| 203 first half |
| 204 second half |
| 206 liquid reservoir |
| 208 output nozzles |
| 210 front body portion |
| 212 refill unit |
| 214 packet sleeve |
| 216 coupling tab |
| 218 complementary aperture |
| 220 valve frame |
| 222 first formulation pouch |
| 224 second formulation pouch |
| 226 formulation-containing packet |
| 230 shell |
| 400 formulation pouch |
| 402 formulation packet |

TABLE 1-continued

| Listing of Drawing Elements |
|---|
| 404 output nozzle |
| 406 formulation chamber |
| 408 first side of the formulation packet |
| 410 second side of the formulation packet |
| 412 outer tube |
| 414 first side of the outer tube |
| 416 second side of the outer tube |
| 418 first outer tube aperture |
| 420 second outer tube aperture |
| 422 inner tube |
| 424 first side of the inner tube |
| 426 second side of the inner tube |
| 428 first inner tube aperture |
| 430 buoyant element |
| 432 non-gaseous formulation |
| 434 gaseous fluid |
| 436 first inlet channel |
| 438 second inlet channel |
| 440 porous cage |
| 442 aperture of the second side of the inner tube |
| 444 straw-in-straw degassing unit |
| 446 first refill valve |
| 448 second refill valve |

The foregoing aspects and many of the attendant advantages of this disclosure will become more readily appreciated as the same become better understood by reference to the following detailed description, when taken in conjunction with the accompanying drawings.

DETAILED DESCRIPTION

The detailed description set forth below in connection with the appended drawings, where like numerals reference like elements, is intended as a description of various embodiments of the disclosed subject matter and is not intended to represent the only embodiments. Embodiments described in this disclosure are provided merely as examples or illustrations and should not necessarily be construed as preferred or advantageous over other embodiments. The illustrative examples provided herein are not intended to be exhaustive or to limit the claimed subject matter to the precise forms disclosed.

The present disclosure relates generally to a straw-in-straw degassing unit and containers thereof. Liquid containers come in a variety of forms, including bottles, cans, drums, pouches, and the like. Like other fluid containers, fluid pouches are a convenient means for transporting fluids through commercial supply chains, and for storing fluids for use in appliances, such as formulation pouches used in the cosmetic industry, ink packets used in the printing industry, liquid food additives used in the food processing and production industry, and the like. A manufacturer can fill a fluid pouch with a desired fluid, and then such a pouch can be subsequently distributed to an end user. Once the end user receives the fluid pouch, they can install in an appliance to access the fluids inside, and when the end user has used the contents of the fluid pouch, the fluid pouch can be disposed of or returned to the manufacturer or a re-manufacturer for refilling. An advantage of this arrangement is that the end user can reuse an appliance portion many times, treating the fluids inside as a consumable element of a broader system.

Because the fluid containers, like fluid pouches, are sealed off against the external environment during transportation, fluid containers can prevent messy spills or loss of a deliverable fluid. Additionally, such a sealing-off from the environment can prevent degradation of the fluid, such as may occur due to oxidation with atmospheric oxygen, or the evaporation or loss of volatile fluids over time.

While many fluids can thus be preserved for use by the end user in such a sealed configuration, many fluids undergo off-gassing or decomposition reactions over time, even in the absence of contact with an external environment. In such cases, these undesired side reactions can result in the buildup of gasses inside the fluid container, thus requiring the user to first purge excess gas from the fluid container before the liquid fluid can be accessed. This can result in frustration for the user who must engage in a lengthy priming process before the fluid container can be effectively used and can complicate the use of fluid containers when coupled with particular appliances, such as peristaltic pumps, which do not function properly when exposed to mixtures of gas and liquid.

Accordingly, there is a need for improved devices that enable quick, easy, and clean purging of fluid containers containing liquids that undergo off-gassing. The present disclosure addresses these and other long-felt and unmet needs in the art.

Figure 2:
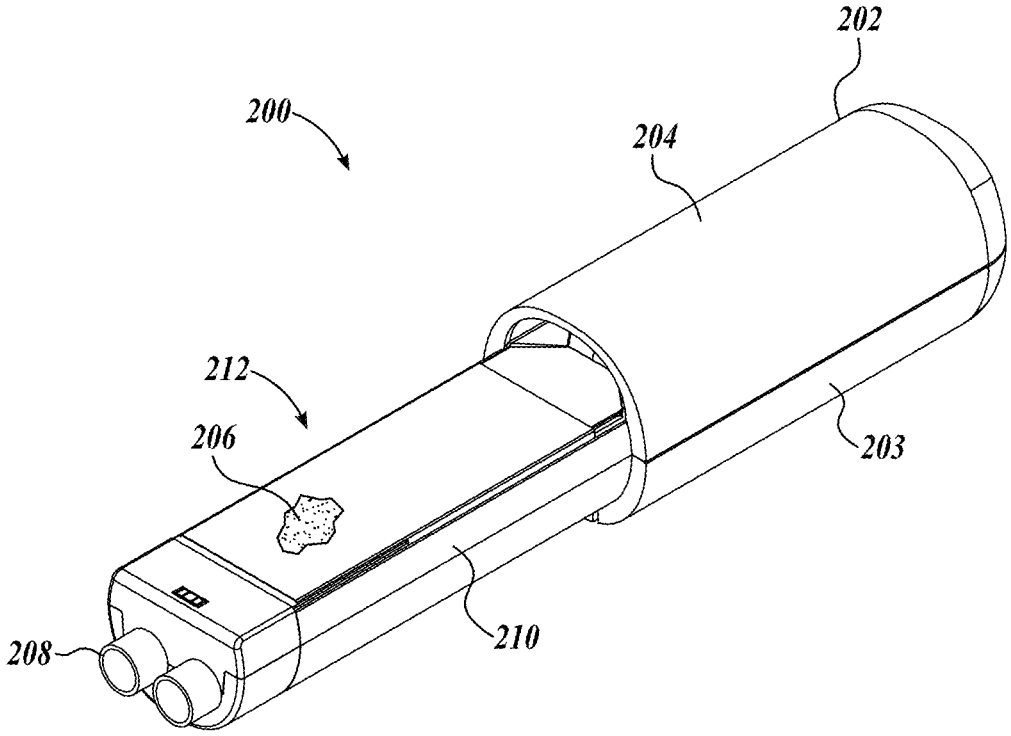
FIG. 2 is a rear perspective view of a formulation cartridge, according to aspects of the present disclosure.
Figure 3:
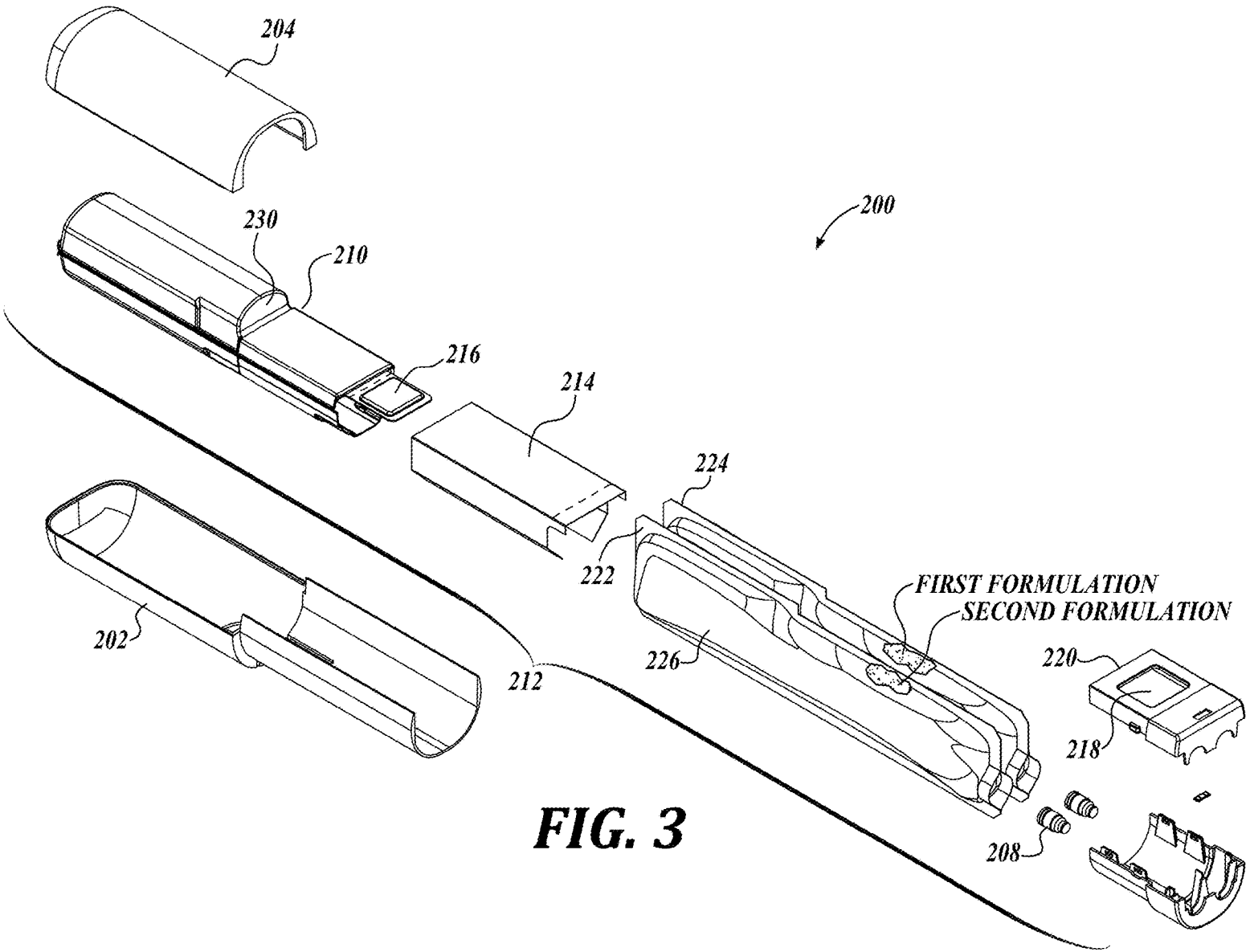
FIG. 3 shows an exploded perspective view of the formulation cartridge of FIG. 3, according to aspects of the present disclosure.

In an aspect, the present disclosure provides a formulation pouch with a straw-in-straw degassing unit, such as one contained in a formulation delivery system 100 with a formulation cartridge 200 (depicted in FIG. 1-FIG. 3). Formulation delivery system 100 is an example of a formulation delivery system described in detail in U.S. patent application Publication Ser. No. 18/060,258A1, published May 30, 2024, which is incorporated by reference herein in its entirety for all purposes. However, it is to be understood that the straw-in-straw degassing unit of the present disclosure can be used for any fluid container system, such as in a system useful in the industries identified above.

Referring initially to FIG. 1, an embodiment of a formulation delivery system 100 is depicted. FIG. 1 illustrates one representative formulation delivery system 100 for housing the straw-in-straw degassing unit, such as a straw-in-straw degassing unit disposed within a fluid pouch, in accordance with the present disclosure. However, it is to be understood that formula delivery system 100 is only one example of an appliance for which a straw-in-straw degassing unit can be used and is therefore a non-limiting example of the use of the straw-in-straw degassing unit.

The formulation delivery system 100 includes a formulation product line 102, a formulation delivery device 104, and an optional formulation 106, which together enable a customized user experience. Formulation product line 102 includes different formulation cartridges 108, where different formulation cartridges 108 can be stored in a same (common) cartridge type that is configured for use with the formulation delivery device 104.

In embodiments, the formulation product line 102 includes a hair coloring formulation and a scalp treatment formulation. In embodiments, the formulation product line 102 comprises at least two, three, four, five, six, seven, or eight of the following different formulations, which can be stored within the same formulation cartridge 108 type: a permanent hair dye and a developer; a semi-permanent hair dye and a developer; a shampoo; a conditioner; a hair growth treatment such as minoxidil; a hair protein treatment; a disulfide bond repairing hair treatment; or a fluid scalp treatment. In embodiments, the formulation product line 102 includes any of the above combinations, in addition to an optional cleaning cartridge of the same formulation cartridge 108 type.

Formulation cartridge 108 type has an elongate shape and dimensions configured for insertion into a handle of the formulation delivery device 104, in particular into a cartridge cavity of the handle. In embodiments of the formulation delivery system 100, the elongate outer housing has a different construction between formulation cartridge 108 containing formulation and the cleaning cartridge, but with common a common shape and dimensions. For example, in embodiments, formulation cartridge 108 containing formulation have the construction of the partially recyclable embodiment shown in FIG. 2-FIG. 3, while the cleaning cartridge has similar shape and dimensions, but different materials and components.

Another feature of the formulation cartridge 108 type is a plurality of liquid output nozzles, which are sized and positioned at a distal (forward) end of the formulation cartridge 108 in a configuration that fluidically connects with a corresponding plurality of liquid inlets (e.g., first formulation inlets). In embodiments, the liquid output nozzles are valves of formulation vessels (e.g., pouches or packets) disposed in the formulation cartridge 108.

A representative formulation cartridge 108 type, which is configured for insertion into formulation delivery device 104 and for storing a first formulation and a second formulation, is described below in FIG. 2-FIG. 3.

The cleaning cartridge, which is of the common formulation cartridge 108 type (i.e., has common exterior dimension and a plurality of liquid output nozzles), enables a user to clean the formulation delivery device 104 by executing a cleaning routine that flushes a cleaning liquid (e.g., water) from the cleaning cartridge through the fluid conduits of the formulation delivery device 104, thereby removing residual formulation in the formulation delivery device 104. Advantageously, the cleaning cartridge and cleaning routine enable a significant portion of the formulation delivery device 104 to be reused for different formulations, thereby reducing waste and cost.

The cleaning cartridge includes a refillable cleaning liquid reservoir disposed inside the outer housing, which is fluidically connected to the plurality of output nozzles. Thus, a user can fill the cleaning liquid reservoir with a cleaning liquid such as water, execute a number of cleaning routines on the formulation delivery device 104, and refill the cleaning liquid reservoir.

FIG. 2-FIG. 3 show a representative formulation cartridge 200 of a formulation cartridge type which is compatible with any of the formulation delivery systems, formulation delivery devices, and formulation product lines described herein. However, the formulation delivery systems, formulation delivery devices, and formulation product lines described herein are not required to use the sustainable formulation cartridge 200 shown in FIG. 2-FIG. 3.

Formulation cartridge 200 is a sustainable embodiment specifically designed to reduce waste and environmental impact, while delivering a user-friendly experience. To that end, formulation cartridge 200 includes two main components: a handle portion 202 and a disposable formulation cartridge refill unit 212 (hereinafter referred to simply as refill unit 212) configured to reversibly slide into the handle portion 202. Historically, known cartridges were designed to be entirely disposed after depletion of the formulation stored therein, leading to significant waste and higher consumer cost.

In contrast to known cartridges, the formulation cartridge 200 is constructed such that the handle portion 202 can be reused indefinitely and the refill units 212 can be readily replaced after depletion of the formulation stored therein. Further still, refill unit 212 can be configured to be deconstructed into smaller components, some of which can be recycled in embodiments, and others disposed of. Thus, the formulation cartridge 200 utilizes an innovative structure to reduce waste and improve the user experience.

Handle portion 202 is sized, dimensioned, and constructed to be repeatedly inserted into the cartridge cavity of the formulation delivery device. Accordingly, handle portion 202 is formed of ABS plastic or similar rigid polymer or other material and includes a hollow handle portion 202 configured to receive the refill unit 212 therein.

Figure 4:
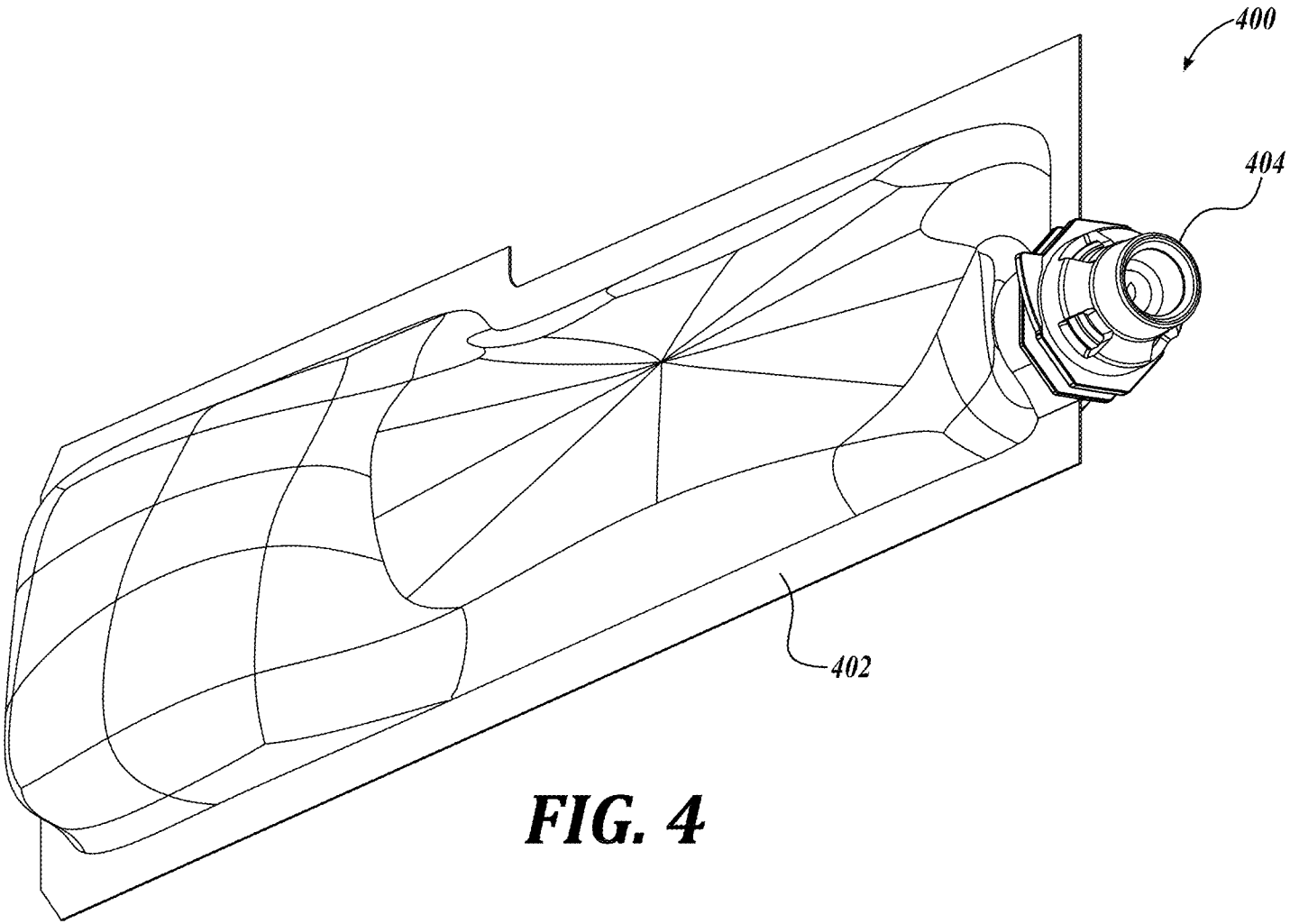
FIG. 4 shows a perspective view of a formulation pouch, according to aspects of the present disclosure.

Refill unit 212 generally includes a refill packet comprising a shell 230 enclosing at least one formulation vessel (e.g., a packet, pouch, or other vessel), for example a first formulation pouch 222 and a second formulation pouch 224, and a valve frame 220 coupled with the refill packet, e.g., a front body portion 210. In embodiments, the at least one formulation vessel is a liquid reservoir 206. The first formulation pouch 222 and second formulation pouch 224 respectively contain a first formulation and a second formulation. The refill unit 212 may optionally include packet sleeve 214. In embodiments, the at least one formulation vessel is an example of formulation pouch 400 comprising a formulation packet 402 and an output nozzle 404, as is depicted in FIG. 4.

The first formulation pouch 222 and second formulation pouch 224 can have a volume of about 40 mL to about 70 mL, about 50 mL to about 60 mL, about 40 mL to about 65 mL, about 40 mL to about 60 mL, about 40 mL to about 55 mL, about 40 mL to about 50 mL, about 45 mL to about 70 mL, about 50 mL to about 70 mL, about 55 mL to about 70 mL, about 60 mL to about 70 mL, or about 55 mL. In embodiments, first formulation pouch 222 and second formulation pouch 224 have different volumes. In embodiments, refill unit 212 stores only a single formulation vessel.

The first formulation and second formulation can be independently selected from any of the formulations described herein, for example a permanent hair dye; semi-permanent hair dye; developer; conditioner; hair growth treatment, such as minoxidil; hair protein treatment; disulfide bond repairing hair treatment; fluid hair treatment; fluid scalp treatment, or the like. In embodiments, the first formulation and second formulation differ. For example, in embodiments, the first formulation is a hair dye and the second formulation is a developer. In other embodiments, the first formulation and second formulation are the same (e.g., a conditioner or scalp treatment formulation).

As shown in FIG. 3, formulation pouches 222, 224 include a formulation-containing packet 226 and valve means comprising output nozzles 208 for selectively-fluidic coupling the refill unit to a dispensing nozzle unit of a formulation delivery device when the formulation cartridge 200 is received within the hand-held formulation dispensing device. Representative valve means include a valve through which the formulation exits the formulation-containing packet 226. Representative formulation vessels are described in International Patent Application Publication No. 2019/067336A2, published Apr. 4, 2019, and U.S. Patent Application Publication No. 2021/0196021A1, published Jul. 1, 2021, and both of which are hereby incorporated by reference in their entireties for all purposes.

The shell 230 has an elongate shape sized to be received within the reusable handle portion 202. The shell 230 encloses and protects the first formulation pouch 222 and second formulation pouch 224 and engages the valve frame 220 (described below). Thus, the shell 230 functions as packaging which protects the formulation pouches 222, 224 during commerce prior to loading into the formulation delivery device.

In embodiments, the shell 230 has a total length between 150 mm and 250 mm (e.g., 175 mm-225 mm, 185 mm-215 mm, 195 mm-205 mm, or 200 mm) and a maximum cross-sectional dimension of 25 mm-50 mm (e.g., 30 mm-45 mm, 35 mm-40 mm, or 36 mm). The shell 230 has a rear body portion and a slender front body portion 210, e.g., a neck portion, extending away from the body portion. The body portion and the slender front body portion 210 generally align in a common longitudinal direction to enable assembly with the reusable handle portion 202, and to enable insertion into the cartridge cavity of the formulation delivery device. In embodiments, the shell 230 is constructed at least partially from a recyclable or recycled material, e.g., a paper material such as an injection-molded paper material or a die-cut structured paper (e.g., cardboard). In the illustrated embodiment, the shell 230 is formed from a single piece of injection-molded paper material. In embodiments in which the shell is formed of paper, the paper has a weight between 8-12 points (e.g., 8.5 points, 9.0 points, 9.5 points, 10.0 points, 10.5 points, 11.0 points, or 11.5 points), to impart sufficient stiffness without contributing excess disposable material.

The rear body portion of the shell 230 has a larger cross-sectional dimension than the front body portion 210 when viewed in a plane normal to the longitudinal direction of the formulation cartridge 200. A hump or bulge imparts the larger cross-sectional area of the rear body portion relative to the slender front body portion 210. Advantageously, the hump or bulge enables the use of higher-volume formulation pouches 222, 224. Additionally, the hump or bulge forms an abutment which abuts a corresponding interior face of the handle portion 202 and secures the longitudinal position of the shell 230 during use.

The slender front body portion 210 of the shell 230 is sized to fit within the handle portion 202 and to project into the cartridge cavity of the formulation delivery device during use. The front body portion 210 couples with the valve frame 220. To facilitate secure connection and alignment with the valve frame 220, the front body portion 210 includes valve frame coupling means, for example at least one coupling tab 216 configured to selectively engage the valve frame 220. In the illustrated embodiment, the front body portion 210 includes a single coupling tab 216 extending away from a front end thereof. The coupling tab 216 includes an engagement feature, for example a detent or raised prominence shaped and sized to engage a complementary aperture 218 of the valve frame 220.

Shell 230 may have many different configurations. For example, referring to FIG. 3, the illustrated shell 230 is a clamshell configuration formed with at least two partial shells (in this embodiment, first half 203 and second half 204) hingedly coupled. In embodiments, the shell 230 includes a different number of partial shells, e.g., three or four partial shells which come together to enclose the formulation pouches 222, 224. In still other embodiments, shell 230 comprises a single piece forming an open-ended tube into which the formulation pouches 222, 224 may be inserted. Alignment of the first half 203 and second half 204 enables correct attachment of the front body portion 210 to the valve frame 220.

While the illustrated shell 230 is formed of an injection molded paper material, this construction is representative, not limiting. In embodiments, the shell 230 is formed of a single piece of die-cut paper stock, which is folded to impart a three-dimensional structure having the rear body portion and slender front body portion 210 extending away therefrom. In some such embodiments, this folded construction creates a polygonal cross section in the rear body portion and a polygonal cross section in the front body portion 210 (for example, octagonal and hexagonal cross sections, respectively). To facilitate assembly, some such embodiments of the shell 230 include one or more scores or guidelines that ensure correct folding. Embodiments have a triangular, rectangular, pentagonal, hexagonal, heptagonal, octagonal, or other polygonal cross-sectional shape.

Optional packet sleeve 214 slides over the front body portion 210 and provides several important advantages. First, it imparts additional structure to the refill unit 212 by sliding over and reinforcing front body portion 210. Accordingly, in embodiments, packet sleeve 214 has a greater weight or thickness as compared to the material that forms the shell 230; although this is not required. In embodiments, packet sleeve 214 is also formed of a recyclable material, which may be the same material as the shell 230. Second, in embodiments, packet sleeve 214 couples with the valve frame 220. For example, the illustrated packet sleeve 214 includes a plurality of engagement member recesses configured to reversibly couple with engagement members of the valve frame 220. Third, packet sleeve 214 facilitates disassembly of the refill unit 212.

Valve frame 220 provides a rigid structure which aligns the output nozzles 208 for correct fluid interconnection with the fluid conduits of the formulation delivery device. Accordingly, valve frame 220 is formed from acrylonitrile butadiene styrene (ABS) plastic, high-density polyethylene (HDPE), or other rigid polymer or other material. In embodiments, valve frame 220 is formed from a same material as the shell 230.

Thus, the shell 230, formulation pouches 222, 226, valve frame 220, and optional packet sleeve 214 form the refill unit 212. In use, refill unit 212 is reversibly couplable with handle portion 202, e.g., by securing means such as coupling tabs on the shell 230 or by friction fit between the refill unit 212 and the handle portion 202.

Figure 5:
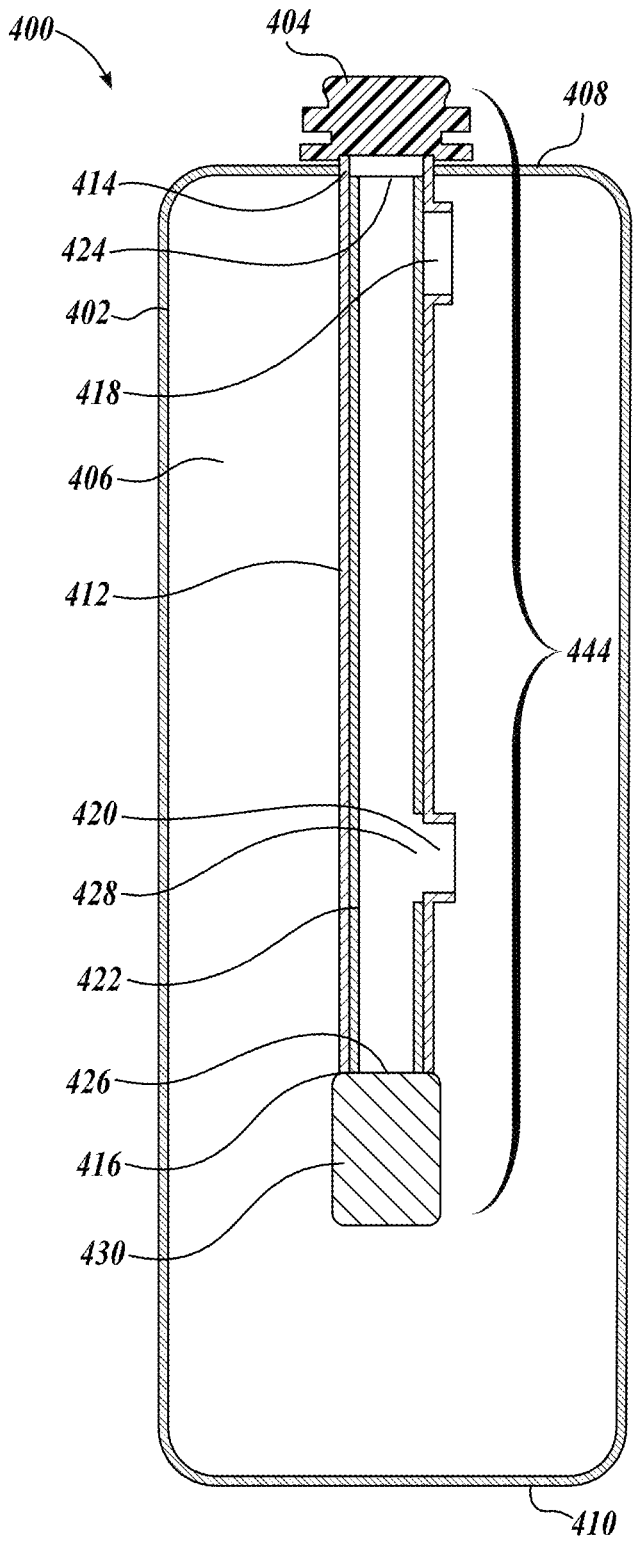
FIG. 5 shows an interior side view of the formulation pouch of FIG. 4, according to aspects of the present disclosure.
Figure 6:
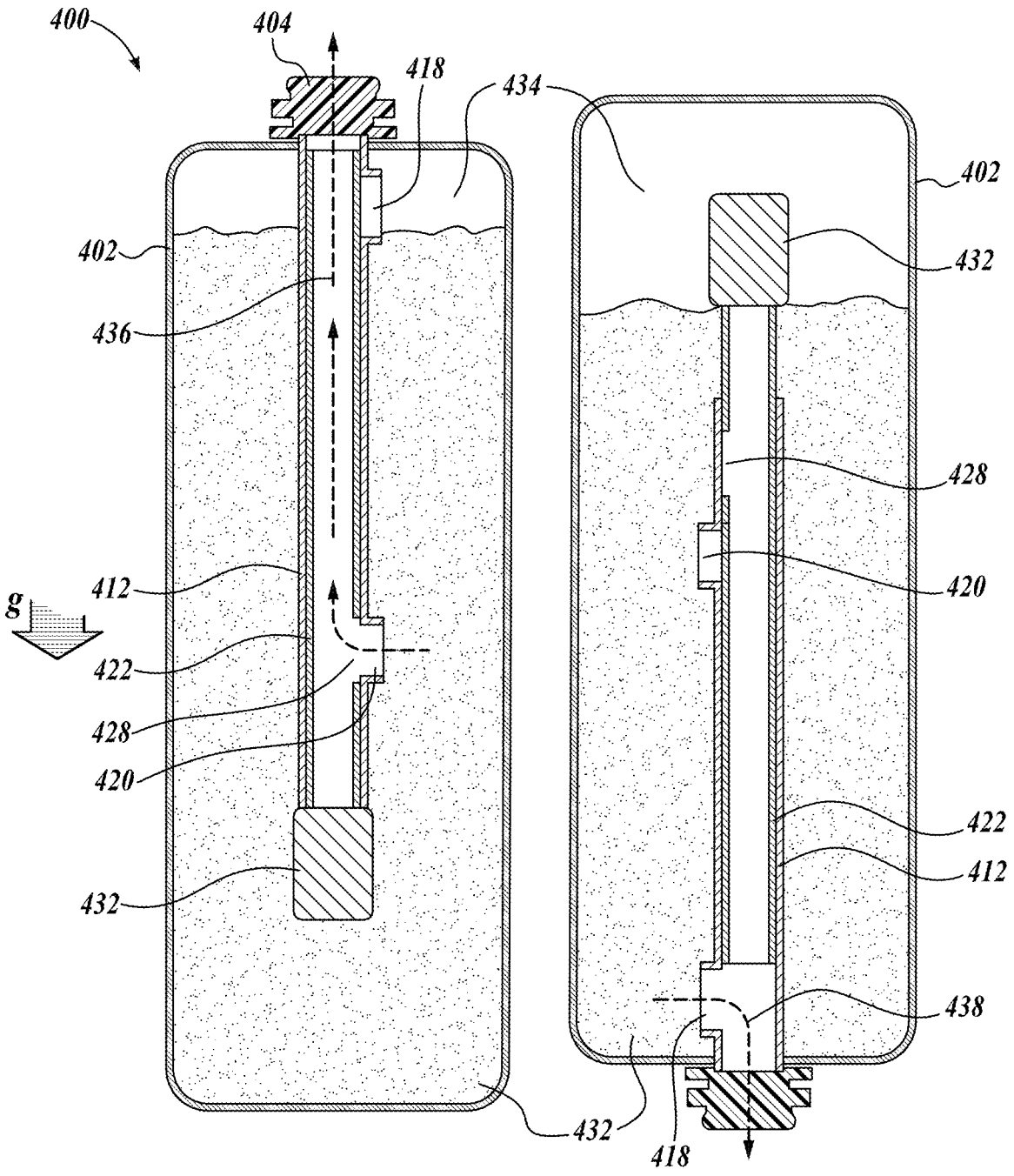
FIG. 6 shows an interior side view of the formulation pouch of FIG. 4 in an upright and an inverted orientation, according to aspects of the present disclosure.

Turning to FIG. 5 and FIG. 6, an interior portion of formulation pouch 400 includes a formulation packet 402, a formulation chamber 406, an outer tube 412, an inner tube 422, and a buoyant element 430.

The formulation packet 402 comprises a plurality of packet walls that define the formulation chamber 406. The formulation chamber 406 is thereby configured for receiving and storing a fluid formulation, such as any of the formulations described herein above. In embodiments, the formulation in the formulation chamber 406 is a non-gaseous formulation 432, a gaseous fluid 434, or a combination thereof. In embodiments, the non-gaseous formulation 432 undergoes off-gassing while sealed within the formulation chamber 406, thereby generating a gaseous fluid 434. Without being bound by theory, when the formulation comprises a developer, such as any of the developer formulations discussed further herein above with respect to FIG. 1, the developer can contain chemical compositions which oxidize during transportation and storage. Such compositions will off-gas until the vapor pressure of gaseous fluid 434 is equivalent to the equilibrium vapor pressure of the non-gaseous formulation 432. Accordingly, the formulation pouch 400 can be a flexible formulation pouch 400 constructed from a flexible material, thereby allowing the formulation pouch 400 to adjust shape to conform to any appliance to which it may be coupled despite changes in the gaseous and non-gaseous volumes contained therein.

Figure 7:
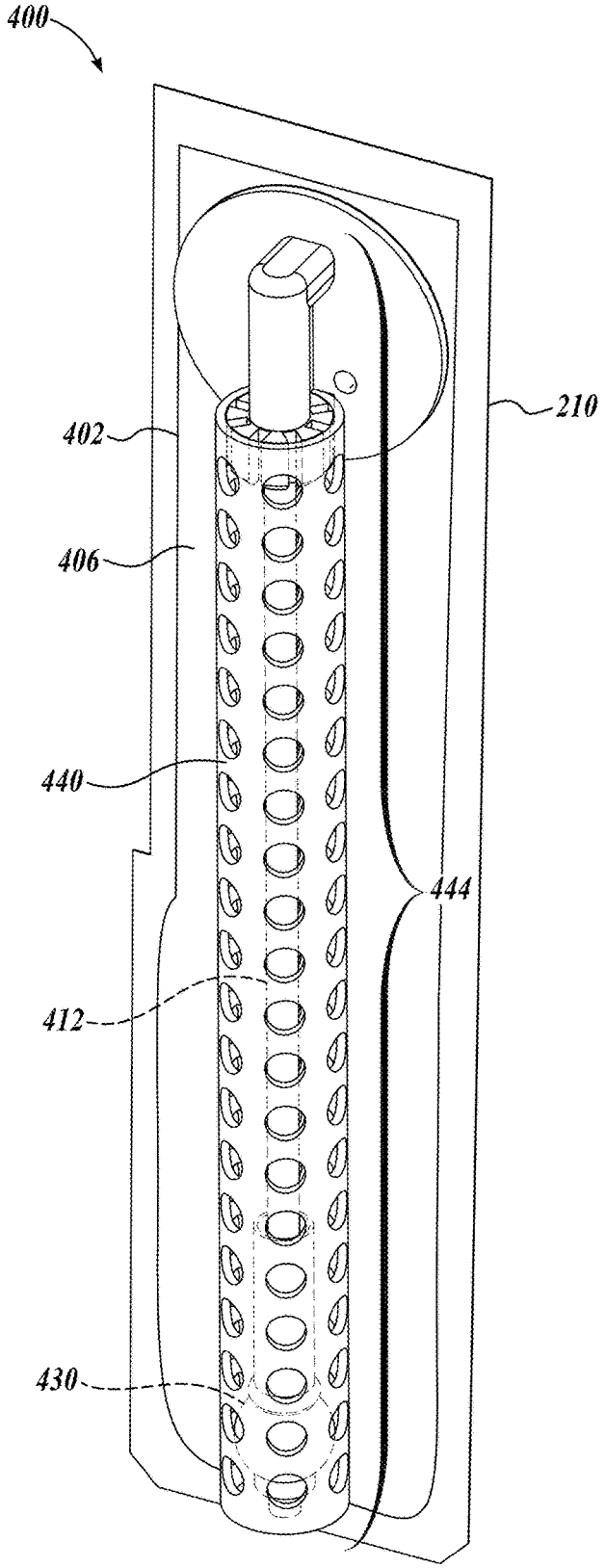
FIG. 7 shows a straw-in-straw degassing unit, according to aspects of the present disclosure.
Figure 9:
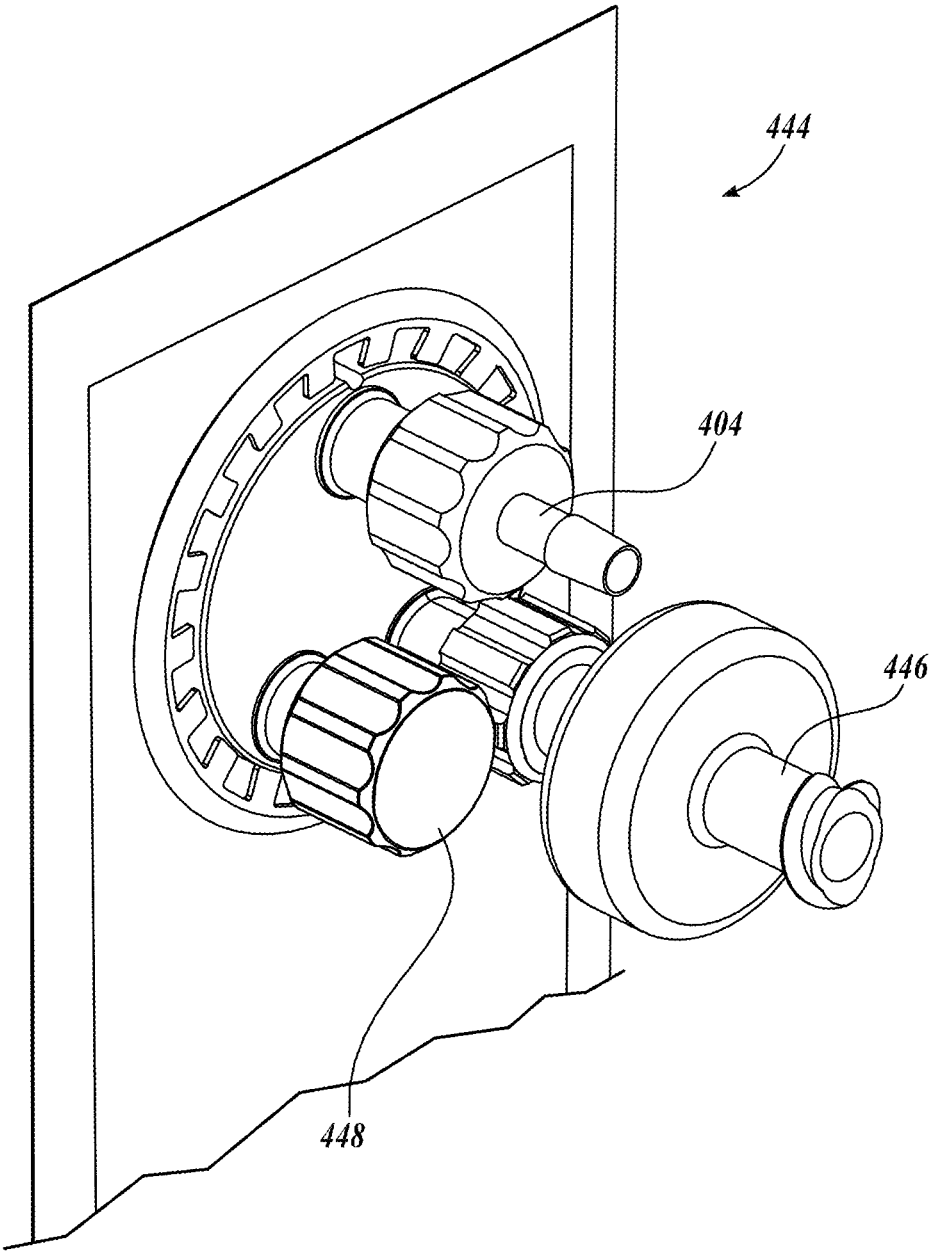
FIG. 9 shows a valve assembly for a straw-in-straw degassing unit, according to aspects of the present disclosure.

In embodiments, the output nozzle 404 is formed in a first side of the formulation packet 408, as depicted in FIG. 5. While the output nozzle 404 can be disposed along an edge of the formulation packet 402, it is to be understood that the output nozzle 404 can be disposed at any position of formulation packet 402, such as along a top side, as depicted in FIG. 7 and FIG. 9. Output nozzle 404 thus includes an outer nozzle side and an inner nozzle side, where the outer nozzle side is substantially external to the formulation packet 402, and where the inner nozzle side is substantially internal to the formulation packet 402 and is therefore in fluid contact with the formulation chamber 406.

Referring to FIG. 9, output nozzle 404 can also be one of a plurality of nozzles in fluid communication with the formulation chamber 406 of the formulation pouch 400. For example, the plurality of nozzles can also include a first refill valve 446 and a second refill valve 448. In embodiments, the first refill valve 446 comprises a one-way valve configured to allow an inflow of non-gaseous formulation into the formulation chamber 406. In embodiments, the second refill valve 448 comprises a one-way valve configured to allow an outflow of gaseous fluid from the formulation chamber 406. Accordingly, in embodiments, the formulation pouch 400 can be refilled and reused without opening the formulation pouch 400.

The outer tube 412 is disposed inside the formulation chamber 406 and comprises a first side of the outer tube 414 and a second side of the outer tube 416. In embodiments, outer tube 412 is a substantially cylindrical tube with a length, an inner diameter, and an outer diameter, wherein the tube is open on both the first side of the outer tube 414 and the second side of the outer tube 416. While the outer tube 412 depicted in FIG. 5 is substantially cylindrical, it is to be understood that the outer tube 412 can define any suitable shape, such as a triangular prism tube, a rectangular prism tube, a hexagonal prism tube, or the like. The first side of the outer tube 414 is coupled to inner nozzle side of the output nozzle 404. Thus, the opening of the 414 is configured to substantially surround a throughput portion of the inner nozzle side of the output nozzle 404, thereby placing an interior of the outer tube in fluid communication with an outlet nozzle side of the output nozzle 404.

Outer tube 412 further includes a first outer tube aperture 418 and a second outer tube aperture 420 defined though a wall of the outer tube 412, thereby creating a flow path for a fluid to flow from the exterior of the outer tube 412 to the interior of the outer tube 412. In embodiments, the first outer tube aperture 418 is positioned in a first outer tube location proximate the first side of the outer tube 414, while the second outer tube aperture 420 is positioned in a second outer tube location proximate the second side of the outer tube 416.

In embodiments, both the first outer tube aperture 418 and second outer tube aperture 420 consist of a single bore; however, it is to be understood that the first outer tube aperture 418 and the second outer tube aperture 420 can include any number of bores, including two or more bores, such as a plurality of micro-bores. Such a plurality of micro-bores can be substantially located along a single side of the outer tube 412, or in embodiments the plurality of micro-bores can be arranged substantially around a circumference of the outer tube 412. Additionally, the first outer tube aperture 418 and the second outer tube aperture 420 can both include the same number of bores, or can include different numbers of bores, such as where the first outer tube aperture 418 includes a plurality of micro-bores and where the second outer tube aperture 420 includes a single bore.

In embodiments, the outer tube 412 includes an additional number of apertures, such as a third outer tube aperture, a fourth outer tube aperture, a fifth outer tube aperture, a sixth outer tube aperture, a seventh outer tube aperture, an eighth outer tube aperture, a ninth outer tube aperture, a tenth outer tube aperture, or more.

In embodiments, inner tube 422 is configured to be nested within a portion of the interior of the outer tube 412. Accordingly, an outer diameter of inner tube 422 is smaller than the inner diameter of outer tube 412. Inner tube 422 includes a first side of the inner tube 424 and a second side of the inner tube 426. In embodiments, inner tube 422 is a substantially cylindrical tube with a length, an inner diameter, and an outer diameter, wherein the tube is open on both the first side of the inner tube 424 and the second side of the inner tube 426. Thus, the second side of the inner tube 426 is in fluid communication with the formulation chamber 406.

While the inner tube 422 depicted in FIG. 5 is substantially cylindrical, it is to be understood that the inner tube 422 can define any suitable shape, such as a triangular prism tube, a rectangular prism tube, a hexagonal prism tube, or the like. In embodiments, the shape of inner tube 422 is substantially the same as the shape of outer tube 412. In embodiments, inner tube 422 is a different shape from outer tube 412.

In embodiments, an exterior of the inner tube 422 is configured to slidably contact the interior of the outer tube 412. The internal friction of this slidable contact allows the inner tube 422 to move relative to the outer tube 412 coupled to the output nozzle 404, yet still prevents a flow of fluid to run between the outer wall of inner tube 422 and the inner wall of outer tube 412, thus allowing for better control of available fluid pathways in the formulation packet 402.

Inner tube 422 further includes a first inner tube aperture 428 defined though a wall of the inner tube 422, thereby creating a flow path for a fluid to flow from the exterior of the inner tube 422 to the interior of the inner tube 422. Because inner tube 422 is in slidable contact with outer tube 412, the first inner tube aperture 428 can thus be configured for an open position when the first inner tube aperture 428 aligns with either the first outer tube aperture 418 or the second outer tube aperture 420. First inner tube aperture 428 can also be configured for a closed position when the first inner tube aperture 428 is not in alignment with either the first outer tube aperture 418 or the second outer tube aperture 420. The open and closed configurations will be discussed further herein below with respect to FIG. 6. In embodiments, the first inner tube aperture 428 is positioned in a first inner tube location configured to be in alignment with the second outer tube aperture 420 when the first side of the inner tube 424 is flush with the contact point between the first side of the outer tube 414 and the output nozzle 404.

In embodiments, the first inner tube aperture 428 consists of a single bore; however, it is to be understood that the first inner tube aperture 428 can include any number of bores, including two or more bores, such as a plurality of micro-bores. Such a plurality of micro-bores can be substantially located along a single side of the inner tube 422, or in embodiments the plurality of micro-bores can be arranged substantially around a circumference of the inner tube 422.

Additionally, the first inner tube aperture 428 and the first and second outer tube apertures 418, 420 can include the same number of bores, or can include different numbers of bores, such as: where the first outer tube aperture 418 includes a single bore, the second outer tube aperture 420 includes a plurality of micro-bores, and where the first inner tube aperture 428 includes a single bore; where the first outer tube aperture 418 includes a plurality of micro-bores, the second outer tube aperture 420 includes a single bore, and where the first inner tube aperture 428 includes a single bore; where the first outer tube aperture 418 includes a plurality of micro-bores, the second outer tube aperture 420 includes a plurality of micro-bores, and where the first inner tube aperture 428 includes a single bore; where the first outer tube aperture 418 includes a single bore, the second outer tube aperture 420 includes a plurality of micro-bores, and where the first inner tube aperture 428 includes a plurality of micro-bores; where the first outer tube aperture 418 includes a plurality of micro-bores, the second outer tube aperture 420 includes a single bore, and where the first inner tube aperture 428 includes a plurality of micro-bores; where the first outer tube aperture 418 includes a single bore, the second outer tube aperture 420 includes a single bore, and where the first inner tube aperture 428 includes a plurality of micro-bores;

In embodiments, the inner tube 422 further comprises an additional number of apertures, such as a second inner tube aperture, a third inner tube aperture, a fourth inner tube aperture, a fifth inner tube aperture, or more.

In embodiments, the buoyant element 430 is coupled to the second side of the inner tube 426. The diameter of the buoyant element 430 is greater than an internal diameter of the outer tube 412, thereby preventing the buoyant element 430 from becoming lodged within the outer tube 412. As such, in embodiments, the buoyant element 430 is disposed exterior to the second side of the outer tube 416 and configured to contact a base of the second side of the outer tube 416. Buoyant element 430 can be coupled to the second side of the inner tube 426 by any suitable means, such as: adhering the buoyant element 430 to a base of the second side of the inner tube 426 with an adhesive compound, wrapping buoyant element 430 substantially around the circumference of the inner tube 422 at the second side of the inner tube 426 so as to leave the base of the second side of the inner tube 426 unblocked as aperture of the second side of the inner tube 442, forming buoyant element 430 and the inner tube 422 out of a single material, such as would be produced via injection molding, and the like. The buoyant element 430 can be made from any suitable material that is shelf stable in contact with a non-gaseous formulation 432 stored in the formulation pouch 400. For example, the polymeric material can be a porous polymeric material, the polymeric material can be doped with metal inclusions, such as a stainless-steel inclusion, or the like. The buoyant element 430 can be a substantially non-polymeric material, such as stainless steel, aluminum, or the like. In embodiments, buoyant element 430 comprises a sealed air pocket.

In embodiments, the buoyant element 430 comprises a buoyant element density. In embodiments, when the formulation chamber 406 is filled with a non-gaseous formulation 432, the buoyant element density is smaller than a magnitude of a density of the non-gaseous formulation 432. In embodiments, the buoyant element density is greater than the magnitude of the density of the non-gaseous formulation 432. In embodiments, buoyant element 430 comprises a polymeric material with a density configured to be either greater or smaller than the magnitude of the density of the non-gaseous formulation 432. In embodiments, the buoyant element density is greater than a magnitude of a density of the gaseous fluid 434.

Turning to FIG. 6, the formulation pouch 400 is shown in both an upright configuration (left) and an inverted configuration (right). It is to be understood that formulation pouch 400 can be used in any configuration, and that these two configurations are depicted solely to illustrate embodiments of the function of the straw-in-straw degassing unit 444. In the illustrated embodiment, the density of buoyant element 430 is less than the density of non-gaseous formulation 432 and greater than the density of gaseous fluid 434.

In the illustrated upright configuration, the density of the buoyant element 430 is less than the density of the non-gaseous formulation 432. Accordingly, the buoyant element 430 rises relative to the non-gaseous formulation 432, pushing the inner tube 422 up to contact the base of the output nozzle 404. A first inlet channel 436 is formed when the first inner tube aperture 428 and the second outer tube aperture 420 align, thereby creating fluid communication between the formulation chamber 406 and the output nozzle 404, allowing formulation to flow. The first side of the inner tube 424 substantially blocks flow through the first outer tube aperture 418. The gaseous fluid 434, having a density less than the density of the non-gaseous formulation 432, also rises to the top of the formulation pouch 400 and is thereby excluded from any flow through the first inlet channel 436.

In the illustrated inverted configuration, the buoyant element 430 again rises relative to the non-gaseous formulation 432, drawing the 422 up and away from the output nozzle 404. The buoyant element 430 sits at the interface of the non-gaseous formulation 432 and the gaseous fluid 434. A second inlet channel 438 is formed when the first side of the inner tube 424 slides upwards relative to the first outer tube aperture 418, thereby opening fluid communication between the formulation chamber 406 and the output nozzle 404. At the same time, the first inner tube aperture 428 moves upwards relative to the outer tube 412 such that the first inner tube aperture 428 is not aligned with the second outer tube aperture 420. The gaseous fluid 434 rises to the top of the 400. Accordingly, flow is substantially blocked through the second outer tube aperture 420, ensuring that gaseous fluid 434 is excluded from the flow path to the 404.

While the above examples refer to "upright", "inverted", "up", "down", and other relative positional terms, it is to be understood that the movement of the buoyant element 430 and the inner tube 422 relative to the outer tube 412 can be affected in any orientation by gravity and is not limited to the configurations depicted in FIG. 6. In embodiments, the movement of the buoyant element 430 and the inner tube 422 relative to the outer tube 412 can be affected in any orientation by centrifugal forces.

Figure 8:
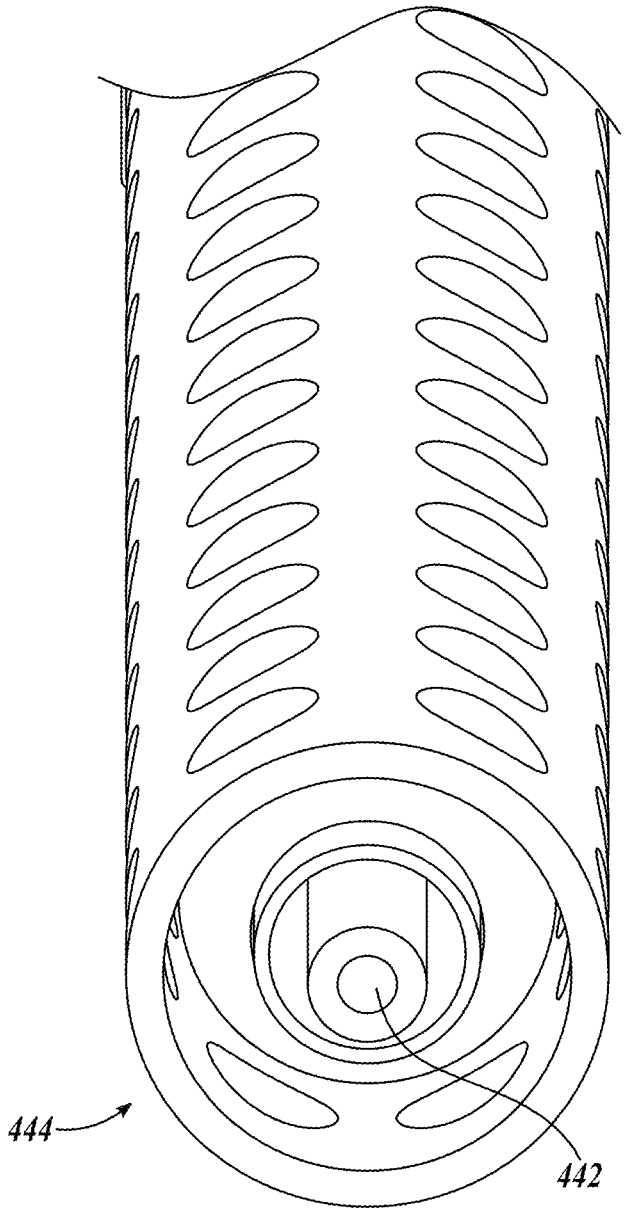
FIG. 8 shows a bottom perspective view of a straw-in-straw degassing unit, according to aspects of the present disclosure.

Referring next to FIG. 7 and FIG. 8, a porous cage 440 can be arranged to substantially surround the straw-in-straw degassing unit 444. In embodiments, porous cage 440 is coupled to the output nozzle 404 and extends the entire length of the straw-in-straw degassing unit 444 and contacts a second side of the formulation packet 410. In embodiments, porous cage 440 extends the entire length of the formulation chamber 406. Without being bound by theory, the porous cage 440 provides a rigid protection layer around the outer tube 412 and the buoyant element 430, thereby preventing either the outer tube 412 or the buoyant element 430 from contacting the wall of the formulation pouch 400. To that effect, the porous cage 440 allows the straw-in-straw degassing unit 444 to function regardless of the material and flexibility of the formulation pouch 400. The porosity of the porous cage 440 can be customized to allow more or less flow of non-gaseous formulation 432 to permeate from the portion of the formulation chamber 406 exterior of the porous cage 440 to the portion of the formulation chamber 406 that is interior to the porous cage 440.

The detailed description set forth above in connection with the appended drawings, where like numerals reference like elements, are intended as a description of various embodiments of the present disclosure and are not intended to represent the only embodiments. Each embodiment described in this disclosure is provided as a representative example or illustration and should not be construed as preferred or advantageous over other embodiments. The representative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification. That is, the present disclosure includes embodiments that combine features from different embodiments.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

In the claims and for purposes of the present disclosure, the terms "a", "an", "the", and the like, refer to the singular and the plural forms of the object or element referenced.

The present application may include references to directions, such as "vertical," "horizontal," "front," "rear," "left," "right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

NON-LIMITING EMBODIMENTS

While general features of the disclosure are described and shown and particular features of the disclosure are set forth in the claims, the following non-limiting embodiments relate to features, and combinations of features, that are explicitly envisioned as being part of the disclosure. The following non-limiting Embodiments contain elements that are modular and can be combined with each other in any number, order, or combination to form a new non-limiting Embodiment, which can itself be further combined with other non-limiting Embodiments.

Embodiment 1. A straw-in-straw degassing unit comprising: an output nozzle; an outer tube, the outer tube comprising a first side and a second side, wherein the first side of the outer tube is coupled to the output nozzle, thereby placing an interior of the outer tube in fluid communication with an outlet of the output nozzle, the outer tube further comprising: a first outer tube aperture defined along a wall of the outer tube in a first outer tube location proximate the first side of the outer tube, and a second outer tube aperture defined along the wall of the outer tube in a second outer tube location proximate the second side of the outer tube; an inner tube nested within an interior of the outer tube and wherein an exterior of the inner tube is configured to slidably contact the interior of the outer tube, the inner tube comprising a first side and a second side, the inner tube further comprising a first inner tube aperture defined along a wall of the inner tube; and a buoyant element coupled to the second side of the inner tube and disposed exterior to the second side of the outer tube, wherein a diameter of the buoyant element is greater than an internal diameter of the outer tube.

Embodiment 2. A formulation pouch, comprising: a formulation packet defining a formulation chamber; and the straw-in-straw degassing unit of Embodiment 1, wherein the straw-in-straw degassing unit is disposed within the formulation chamber, and wherein the output nozzle is disposed at a first side of the formulation packet.

Embodiment 3. The formulation pouch with a straw-in-straw degassing unit of Embodiment 2 or any other Embodiment, further comprising a non-gaseous formulation disposed inside the formulation chamber.

Embodiment 4. The formulation pouch with a straw-in-straw degassing unit of Embodiments 2-3 or any other Embodiment, wherein the non-gaseous formulation comprises a formulation density, wherein the buoyant element comprises a buoyant element density, and wherein a magnitude of the buoyant element density is smaller than a magnitude of the formulation density.

Embodiment 5. The formulation pouch with a straw-in-straw degassing unit of Embodiments 2-4 or any other Embodiment, wherein the buoyant element comprises an encapsulated air pocket.

Embodiment 6. The formulation pouch with a straw-in-straw degassing unit of Embodiment 2-5 or any other Embodiment, wherein, when the first inner tube aperture aligns with the second outer tube aperture, a first inlet channel is defined, thereby permitting a flow of non-gaseous formulation from the formulation chamber, through the second outer tube aperture, the first inner tube aperture, and an interior of the inner tube, and out through the output nozzle.

Embodiment 7. The formulation pouch with a straw-in-straw degassing unit of Embodiment 2-6 or any other Embodiment, wherein, when the first inner tube aperture is not aligned with the second outer tube aperture, a second inlet channel is formed through the first outer tube aperture, thereby permitting a flow of non-gaseous formulation from the formulation chamber, through the first outer tube aperture and an interior of the outer tube, and out through the output nozzle.

Embodiment 8. The formulation pouch with a straw-in-straw degassing unit of Embodiment 2-7 or any other Embodiment, wherein the first inner tube aperture comprises a plurality of first inner tube micro-bores formed around a circumference of the inner tube.

Embodiment 9. The formulation pouch with a straw-in-straw degassing unit of Embodiment 2-8 or any other Embodiment, wherein the first outer tube aperture comprises a plurality of first outer tube micro-bores formed substantially around a circumference of the outer tube at the first outer tube location.

Embodiment 10. The formulation pouch with a straw-in-straw degassing unit of Embodiment 2-9 or any other Embodiment, wherein the second outer tube aperture comprises a plurality of second outer tube micro-bores formed substantially around a circumference of the outer tube at the second outer tube location.

Embodiment 11. The formulation pouch with a straw-in-straw degassing unit of Embodiment 2-10 or any other Embodiment, wherein the second side of the inner tube defines an aperture that is in fluid communication with the formulation chamber.

Embodiment 12. The formulation pouch with a straw-in-straw degassing unit of Embodiment 2-11 or any other Embodiment, wherein the outer tube further comprises a third outer tube aperture, a fourth outer tube aperture, a fifth outer tube aperture, a sixth outer tube aperture, a seventh outer tube aperture, an eighth outer tube aperture, a ninth outer tube aperture, or a tenth outer tube aperture.

Embodiment 13. The formulation pouch with a straw-in-straw degassing unit of Embodiment 2-12 or any other Embodiment, wherein the inner tube further comprises a second inner tube aperture, a third inner tube aperture, a fourth inner tube aperture, or a fifth inner tube aperture.

Embodiment 14. The formulation pouch with a straw-in-straw degassing unit of Embodiment 2-13 or any other Embodiment, further comprising a porous cage configured to encapsulate the outer tube and buoyant module without contacting the outer tube or buoyant module.

Embodiment 15. The formulation pouch with a straw-in-straw degassing unit of Embodiment 2-14 or any other Embodiment, wherein the porous cage contacts a second side of the formulation packet.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A straw-in-straw degassing unit, comprising:

an output nozzle;

an outer tube comprising a first side and a second side, wherein the first side of the outer tube is coupled to the output nozzle, thereby placing an interior of the outer tube in fluid communication with an outlet of the output nozzle, the outer tube further comprising:

a first outer tube aperture defined along a wall of the outer tube in a first outer tube location proximate the first side of the outer tube, and a second outer tube aperture defined along the wall of the outer tube in a second outer tube location proximate the second side of the outer tube;

an inner tube nested within an interior of the outer tube and wherein an exterior of the inner tube is configured to slidably contact the interior of the outer tube, the inner tube comprising a first side and a second side, the inner tube further comprising a first inner tube aperture defined along a wall of the inner tube; and a buoyant element coupled to the second side of the inner tube and disposed exterior to the second side of the outer tube, wherein a diameter of the buoyant element is greater than an internal diameter of the outer tube.

2. A formulation pouch, comprising:

a formulation packet defining a formulation chamber; and the straw-in-straw degassing unit of claim 1, wherein the straw-in-straw degassing unit is disposed within the formulation chamber, and wherein the output nozzle is disposed at a first side of the formulation packet.

3. The formulation pouch of claim 2, further comprising a non-gaseous formulation disposed inside the formulation chamber.

4. The formulation pouch of claim 3, wherein the non-gaseous formulation comprises a formulation density, wherein the buoyant element comprises a buoyant element density, and wherein a magnitude of the buoyant element density is smaller than a magnitude of the formulation density.

5. The formulation pouch of claim 2, wherein the buoyant element comprises an encapsulated air pocket.

6. The formulation pouch of claim 2, wherein, when the first inner tube aperture aligns with the second outer tube aperture, a first inlet channel is defined, thereby permitting a flow of non-gaseous formulation from the formulation chamber, through the second outer tube aperture, the first inner tube aperture, and an interior of the inner tube, and out through the output nozzle.

7. The formulation pouch of claim 2, wherein, when the first inner tube aperture is not aligned with the second outer tube aperture, a second inlet channel is formed through the first outer tube aperture, thereby permitting a flow of non-gaseous formulation from the formulation chamber, through the first outer tube aperture and an interior of the outer tube, and out through the output nozzle.

8. The formulation pouch of claim 2, wherein the first inner tube aperture comprises a plurality of first inner tube micro-bores formed around a circumference of the inner tube.

9. The formulation pouch of claim 2, wherein the first outer tube aperture comprises a plurality of first outer tube micro-bores formed around a circumference of the outer tube at the first outer tube location.

10. The formulation pouch of claim 2, wherein the second outer tube aperture comprises a plurality of second outer tube micro-bores formed around a circumference of the outer tube at the second outer tube location.

11. The formulation pouch of claim 2, wherein the second side of the inner tube defines an aperture that is in fluid communication with the formulation chamber.

12. The formulation pouch of claim 2, wherein the outer tube further comprises a third outer tube aperture, a fourth outer tube aperture, a fifth outer tube aperture, a sixth outer tube aperture, a seventh outer tube aperture, an eighth outer tube aperture, a ninth outer tube aperture, or a tenth outer tube aperture.

13. The formulation pouch of claim 2, wherein the inner tube further comprises a second inner tube aperture, a third inner tube aperture, a fourth inner tube aperture, or a fifth inner tube aperture.

14. The formulation pouch of claim 2, further comprising a porous cage configured to encapsulate the outer tube and buoyant module without contacting the outer tube or buoyant module.

15. The formulation cartridge of claim 14, wherein the porous cage contacts a second side of the formulation packet.

* * * * *